US005285838A

United States Patent [19]

Rapp et al.

[11] Patent Number: 5,285,838

[45] Date of Patent: Feb. 15, 1994

[54] ROTARY TUBULAR HEADRAIL BLIND DESIGN

[75] Inventors: William H. Rapp, Buena Park, Calif.; Ira Gaber, West Norwalk, Conn.; Cooper C. Woodring, Topeka, Kans.

[73] Assignee: Nien Made Enterprise Co., Ltd., Chang Hua, Taiwan

[21] Appl. No.: 985,960

[22] Filed: Dec. 4, 1992

[51] Int. Cl.[5] ..... E06B 9/36

[52] U.S. Cl. ..... 160/168.1; 160/176.1

[58] Field of Search ..... 160/177, 176.1, 174, 160/168.1, 170, 171, 173, 178.1, 178.2, 166.1

[56] References Cited

U.S. PATENT DOCUMENTS 2,544,184 3/1951 Rosenbaum ..... 160/177

2,555,709 6/1951 Sherwood ..... 160/168.1

2,620,866 12/1952 Rosenbaum ..... 160/177

3,552,473 1/1971 Persson ..... 160/176.1 X 3,605,852 9/1971 Vecchiarelli ..... 160/168.1

*Primary Examiner*—David M. Purol

*Attorney, Agent, or Firm*—Bacon & Thomas

[57] ABSTRACT

A rotary tubular headrail blind comprising a tubular headrail with plurality of suspending ladder sets to support a plurality of horizontal slats in parallel, a tubular foot rail, a tilter to rotate the tubular headrail directly, a lifter to raise the tubular foot rail to any desired level, and a holder with two ends to tie each ladder set's inner and outer ladder tapes to maintain the inner and outer ladder tapes close and parallel with each other when the tubular headrail is rotated so that all slats are kept in a same tilting degree.

8 Claims, 12 Drawing Sheets

ROTARY TUBULAR HEADRAIL BLIND DESIGN

BACKGROUND OF THE INVENTION (1) Field of the Invention

The present invention relates to a Venetian blind, particularly a Venetian blind with a rotary tubular headrail.

(2) Description of the Prior Art

Each Venetian blind is composed of a plurality of vertical or horizontal slats running in parallel, tilting of which can adjust indoor darkness and preserve confidence in personal living. It is being extensively used in offices and homes. The conventional horizontal Venetian blind being used can have its slats tilted and lifted, and comprises mainly a rectangular sectioned and non-rotary headrail, a foot rail, two or more ladders each including an outer ladder tape and an inner ladder tape suspending from the headrail to the foot rail to support a plurality of slats with a plurality of connecting tapes located between the outer and inner ladders, a tilter within the headrail and a transmission device therefor to tilt the slats, and a lifter located within the headrail to raise and lower the slats. The tilter and the transmission device are incorporated with a handle to tilt the slats manually, and are substantially in a form of a drum driven by a worm drive through the handle for rotation, include at least to tilt drums each wound by a ladder to support the ladder, and a transmission shaft located between the tilt drums to rotate the tilt drums simultaneously. When the handle is operated, the ladders are moved linearly by the tilter, transmission shaft and the tilt drums, the outer and inner ladders are moved in two opposite directions to tilt the slats between them. The lifter is incorporated with a lift cord, at least two wires extending from the headrail to the foot rail and connected to the lift cord, and a pulley set. When the lift cord is pulled upwards, the pulley set causes the wires tied to the foot rail to displace upward simultaneously to raise the foot rail as well as all or part of the slats, and consequently cause the lower slats to close to the upper slats.

The conventional tilter and lifter for Venetian blind are quite complicated in structure. Their production cost is high, and it is difficult to implement automatic assemble for mass production. In addition, they have the following defects:

(1) The ladders are wound around or connected to the respective ladder drums, hence the distance between the outer ladder tape and the inner ladder tape near the headrail or foot rail will remain fixed and is equal to the diameter of the ladder drum in spite of the degree of tilting, and such a fixed distance will impose an improper limitation to the ability of the upper and lower few slats to tilt. Generally, the maximum degree of the uppermost slat can tilt is about 65 degree. As for tilting of the slats at the intermediate section, their tilting degree is greater than that of the upper and lower few slats for the ladders themselves are soft wires and they are forced to keep close to each other, i.e., the outer ladder tape and the inner ladder tape are closer to each other than the outer ladder tape and the inner ladder tape near the headrail and foot rail. In other words, when the tilter is adjusted to the maximum tilting degree, the few slats at the top and bottom of the conventional Venetian blind can't be fully seal, and such defect would bring inconvenience to person who desires complete confidence or room darkness. Moreover, the difference in tilting degree of the slats would result in an unharmonious sense, and damage the nice appearance of the Venetian blind.

(3) When the slats are tilting, the inner ladder tape and the outer ladder tape are displaced linearly in two opposite directions, and they are subjected to different gravities. One of the ladders are pulled downward by gravity of the slats and the foot rail, while the other is subject to less tension in comparison with that exists when the slats are located horizontally. Such a difference can bring an adverse to each slat's tilting degree. The top end of the ladder subjected to the gravity has the maximum stretch, and them the effect t the tilting degree is the greatest. On the other hand, the tilting degree of the lowest slat is not effected for the ladder there is not stretched. Together with the inconsistent tilting degree described in paragraph (1) above, such inconsistent stretch prevent a seal or near seal from occurring in the last few slats.

(3) Even the slats are maintained horizontal so that both the inner and other ladders are subjected to the same gravity, the stretch at the top section of each ladder is greater than at the bottom section, hence the interval between two consecutive slats are decreasing gradually from the top to the bottom. Such inconsistent intervals would damage the nice appearance of Venetian blind.

(4) The lifter of the conventional Venetian blind uses a pulley and a cord connecting to two wires to pull up the slats and the foot rail. However, in the cause of raising or lowering, the slats and the foot rail may become higher at one end and lower at the other end due to unbalanced force applied to the wires and the ladders, and in the most serious case the slats and the foot rail may be seized and can't be raised or lowered.

SUMMARY OF THE INVENTION

The present invention provides a revolutionary Venetian blind design concept to overcome the above defects. The Venetian blind according to the present invention comprises a rotary tubular headrail to suspend a plurality of parallel slats and a foot rail with two ladder sets and a plurality of ladder holders of the same structure. An end of the tubular headrail is fixed with a tilter, while another end of the tubular headrail is fixed with a lifter. The tilter and the lifter are each placed in a drum secured to window or door frame. The drums for the tilter and the lifter are of the same structure, each incorporated with an end cover. The tilter includes further a rotary mechanism extended out of the drum and connected to the tubular headrail so that pulling of a tilt cord can drive the rotary mechanism to rotate and consequently rotate the tubular headrail simultaneously so as to tilt the slats suspending from the tubular headrail to any desired angle. The lifter includes further a pulley block secured within the drum, a pulley installed at the pulley block, a brake wheel linearly movable within a guide channel at the pulley block, and a lift cord made of soft material. Both ends of the lift cord are led to pass through the brake wheel and the pulley, and then passed through two outlet at the two drums located at two ends of the headrail, extended downward and tied to two cord holders at two ends of the tubular foot rail. the cord holders are identical to the ladder holders. The cord holders and the ladder holders are interchangeable. By pulling of the lift cord, the slats can be raised and lowered fully or partly to any desired level.

Each ladder holder comprises a top plate to connect to the ladders, two substantially parallel semi-circular extension elements extended downward from both sides of the top plate, and a wedge stop extended from each extension element. The wedge stop is designed to secure the holder in a recession at the headrail or foot rail. When the tubular headrail with the ladder holders are turned for a certain degree, the slats are tilted accordingly, the inner and the outer ladders close to the ladder holder are within the gap between the semi-circular extension elements and are maintained close to each other so that the outer and the inner ladders are maintained parallel when the slats are tilted. Therefore, all the slats are at a same tilting degree which is same with the turning angle of the ladder holders.

Therefore, the main object of the present invention is to provide a horizontal Venetian blind with minimum components and simple structure but without any transmission shaft. It is a design that permits mass production with automatic assembly process at low production cost.

Another object of the present invention is to provide a horizontal Venetian blind which permits efficient and prompt adjustment of slat tilting and assures consistent tilting degree of all the slats without effect from ladder drums and ladder stretch.

Another object of the present invention is to provide a horizontal Venetian blind which permits the greatest tilting angle for full down or up of the slats to provide complete sealing effect.

Another object of the present invention is to provide a horizontal Venetian blink with interchangeable drums for installation of tilter and lifter so that the tilter and lifter can be installed at either end of the headrail to satisfy different user's habit and different indoor installation requirements.

Another object of the present invention is to provide a horizontal Venetian blind to be supplied to the general consumers in the form of a "DIY" kit to permit assembly and replacement of slats by the consumers.

Another object of the present invention is to provide a horizontal blind with consistent interval between any two consecutive slats to improve appearance of the Venetian blind.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
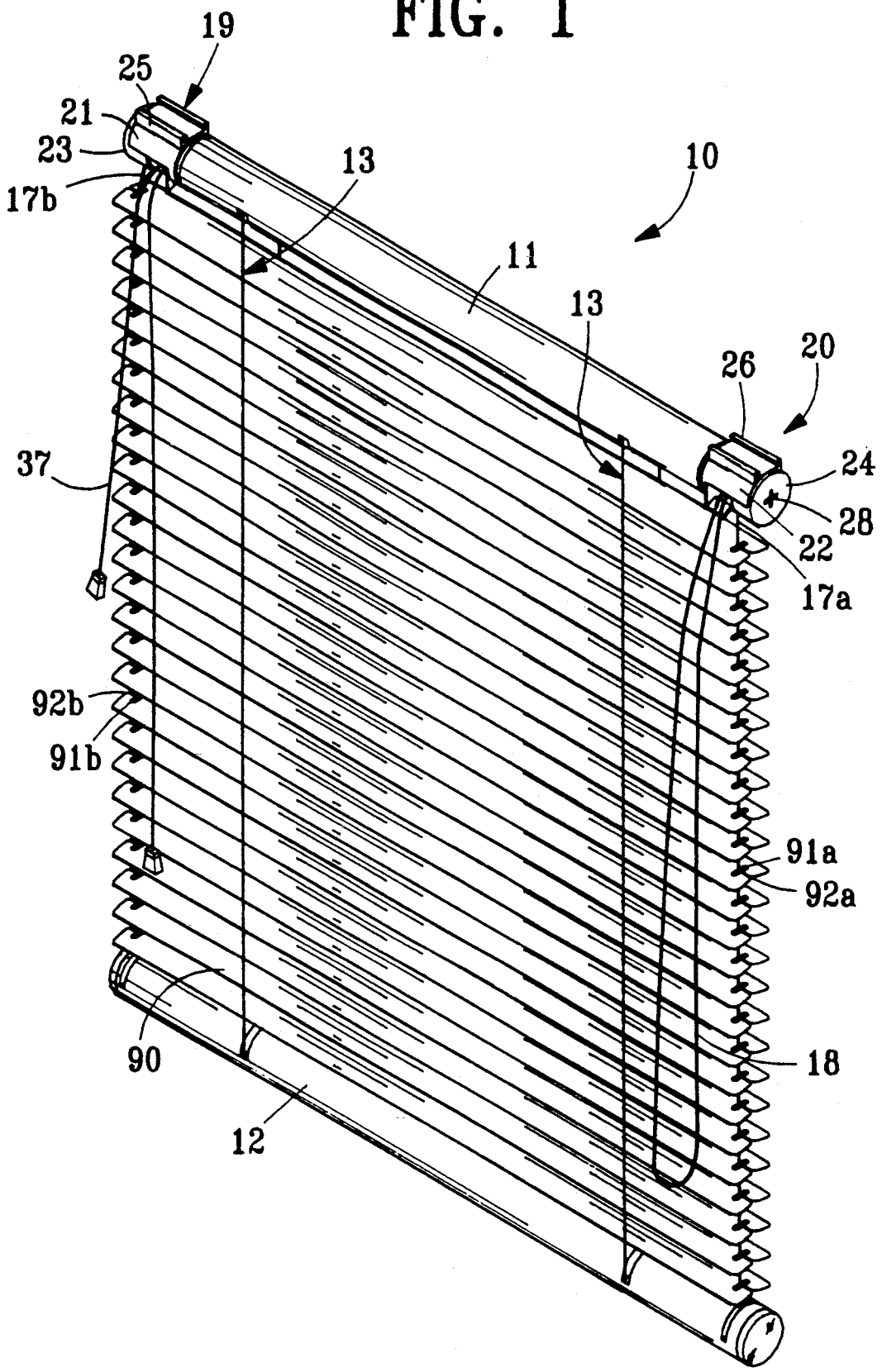
FIG. 1 is a perspective vie of a rotary tubular headrail blind according to the present invention.

Please refer to FIGS. 1 through 4, the horizontal Venetian blind (10) according to the present invention comprises mainly a rotary tubular headrail (11), a foot rail (12), two ladder sets (13) extending from the headrail (11) to the foot rail (12) to support a plurality of parallel horizontal slats (90), a tilter (19) located at any end of the headrail (11), and a lifter (20) located at another end of the headrail (11). Each ladder set (13) is composed of an outer ladder tape (14), an inner ladder tape (15), a plurality of horizontal connecting tapes (16) each beneath a slat (90) to support a slat (90), and two pull cords (**17*a* and 17*b*) extending from the headrail (11) to the foot rail (12) and substantially connected to a lift cord (18) for lifting and lowering of the slats (90) outside the blind (10). When the lift cord (18) is pulled downward manually, the pull cords (17*a* and 17*b*) are raised synchronously to lift the foot rail (12) so that the slats (90) are displaced upward and overlaid in sequence to close the blind (10). The tilter (19) is designed to rotate the slats (90), and the lifter (20) is to lift and lower the slats (90). The tilter (19) includes a hollow drum (21) with an end cover (23), and is fixed to a window frame (93). The lifter (20) also includes a hollow drum (22) with an end cover (24) of exactly the same shape fixed to the window frame (93). Each of the drums (21 and 22) has a pair of upward extended ribs (25 and 26), and each of the end covers (23 and 24) has a cross slot (27 or 28). Each of the drums (21 and 22) can be easily secured to a side of the window frame (93) with the extended ribs (25 and 26) or the cross slot (27 or 28) in association with two conventional fasteners (29 and 30). Hence, the tubular headrail (11), which is designed with a size corresponding to the width of the window frame (93**), is freely rotatably suspended between the drums (21 and 22).

Figure 6:
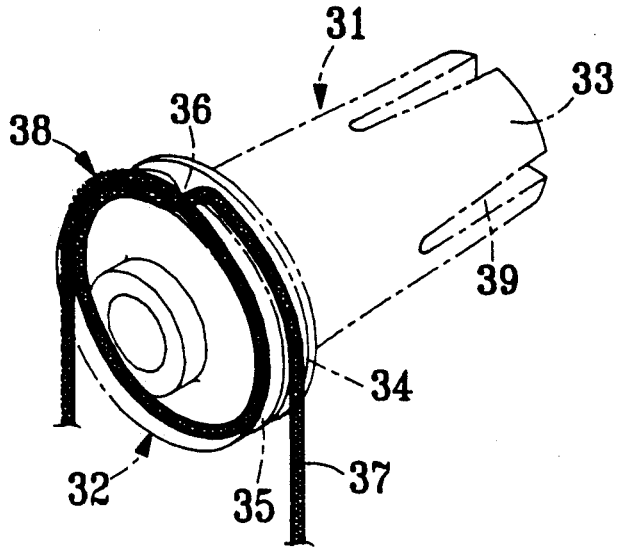
FIG. 6 is a perspective view illustrating wound of a tilt cord around a rotary mechanism in the tilter, in which the rotary mechanism is shown with dashed lines.
Figure 7:
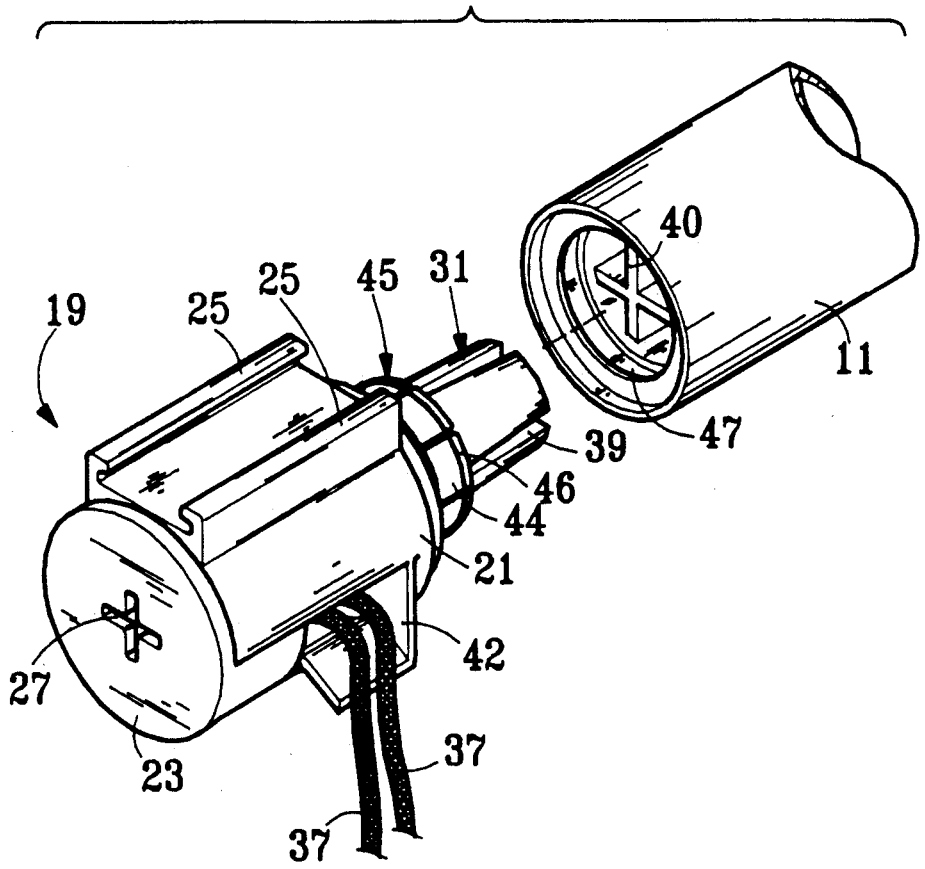
FIG. 7 is a perspective view of the tilter assembly according to the present invention.
Figure 9:
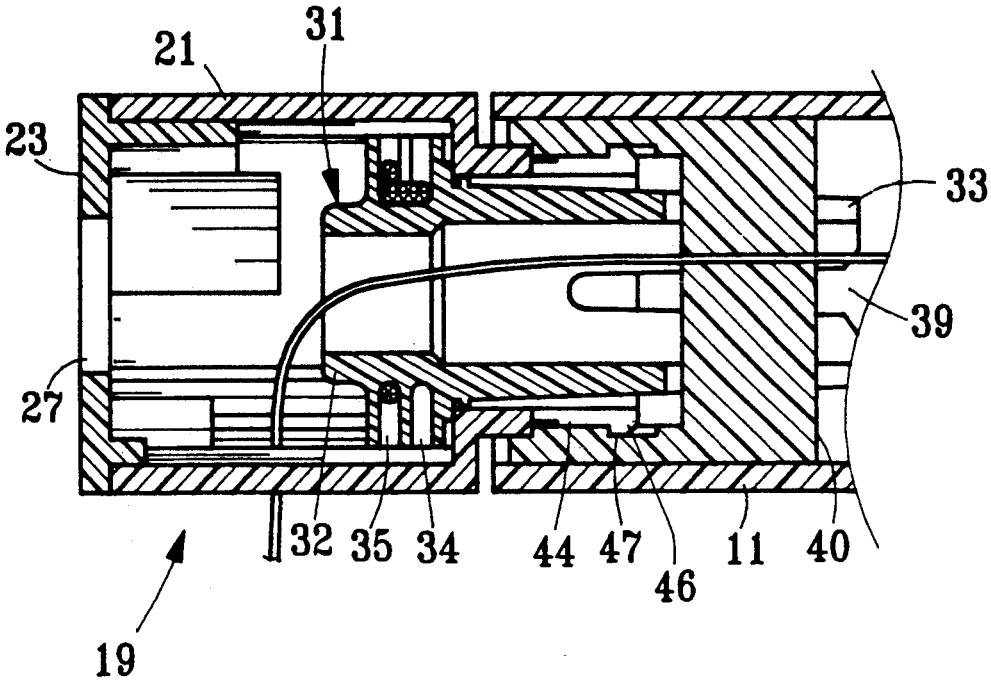
FIG. 9 is a sectional view taken along line 9-9 in FIG. 8.

Please refer to FIGS. 5 thru 9, the tilter (19) to rotate the slats (90) includes further a rotary member (31). The rotary member (31) is a hollow structure with an extended fixing section (33) and a pulley section (32). The pulley section (32) has two cord ways (34 and 35) formed by three rims. A notch (36) is formed at the middle rim so as to connect the cord ways (34 and 35) are connected together. As shown in FIG. 6, a soft tilt cord (37) is wound from a cord way (34) to the other cord way (35) through the notch (36). The tilt cord (37) winding on the cord way (34) has an overlapped portion (38). By friction between the tilt cord (37) and the surface of the cord ways (34 and 35), pulling of the tilt cord (37) can rotate the rotary member. The extended fixing section (33) has four notches (39) arranged in equal distance along its circumference. As shown in FIGS. 7 and 9, the extended fixing section (33) can be partly extended from the drum (21) into the tubular headrail (11), and its four notches (39) are engaged with a cross driven element (40) in the tubular headrail (11) when the rotary member (31) is installed into the drums (21). Therefore, when the rotary member (31) is rotated, the tubular headrail (11) is driven to rotate simultaneously.

Figure 8:
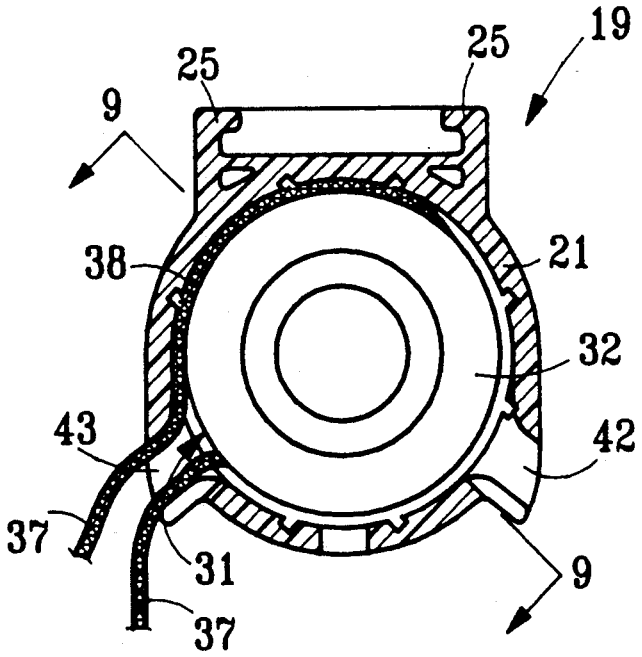
FIG. 8 is a longitudinal sectional view of the tilter according to the present invention.

The drum (21) can be secured to either end, and hence it is designed with a cord outlet (41) in the middle of its bottom side, and two symmetric cord outlets (42 and 43), one at the left side and the other at the right side. As shown in FIGS. 7 and 8, both ends of the tilt cord (37) are extended out of the drum (21) through either the cord outlet (42) or another cord outlet (43) so that an end of the tilt cord (37) can be pulled indoors and consequently the rotary member (31) and the tubular headrail (11) can be driven to rotate clockwise or counterclockwise, and then the ladders (13) is driven to pull the slats (90) to rotate to the desired angle.

The drum (21) has a connecting section (45) composed of a plurality of elastic connecting elements (44) arranged annularly in equal distance near an end of the tubular headrail (11). Each elastic connecting element (44) has a wedged end (46) extending outward. When the connecting section (45) of the drum (21) is fixed in the tubular headrail (11), the wedged ends (46) of the respective elastic connecting elements (44) are retained in a retaining groove (47) in the tubular headrail (11) so that the drum (21) is rotatably connected to the tubular headrail (11) without risk of disengagement.

Figure 10:
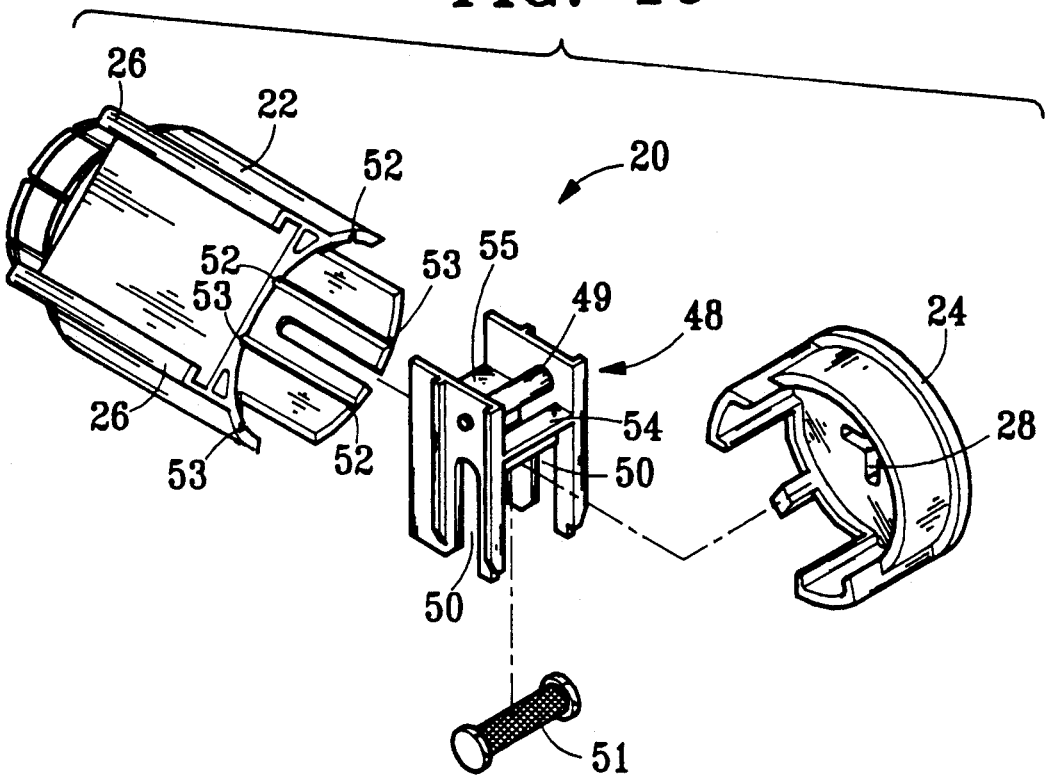
FIG. 10 is a perspective fragmented view of a lifter according to the present invention, in which the lift cord is omitted and all the components have been turned by 45 degree to illustrate shape of such components clearly.
Figure 11:
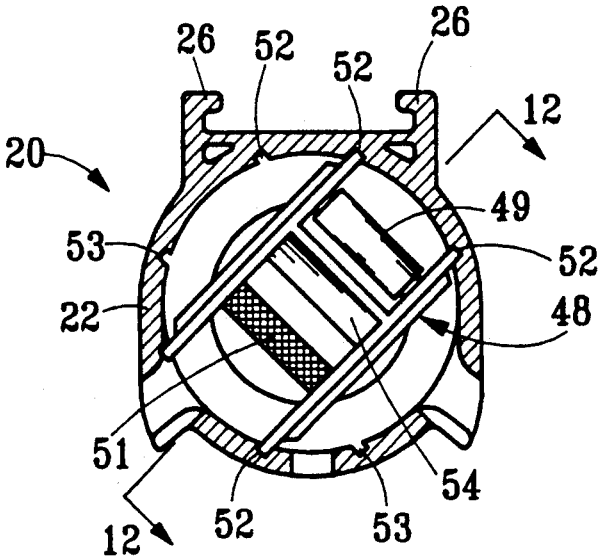
FIG. 11 is a longitudinal view of the lifter according to the present invention.

Please refer to FIGS. 10 and 11, the lifter (20) to lift and lower the slats (90) includes a hollow drum (22) and an end cover (24) having a structure exactly same with the drum (21) and the end cover (23) of the tilter (19), and further includes a pulley block (48) fixed within the drum (22), a pulley (49) attached to the pulley block (48), a brake wheel (51) with teeth-like pattern engraved on its surface and displaced linearly upward and downward within a guide channel (50) at the pulley block (48), and a soft lift cord (18) to be operated manually. As shown in FIG. 11, there are two symmetric slide ways (52 and 53) on the inner wall of the drum (22), one at the left side and the other at the right side for the pulley block (48) to select either of them and to decline inward for about 45 degree so as to engage with the slide way (52 or 53) selected.

Figure 2:
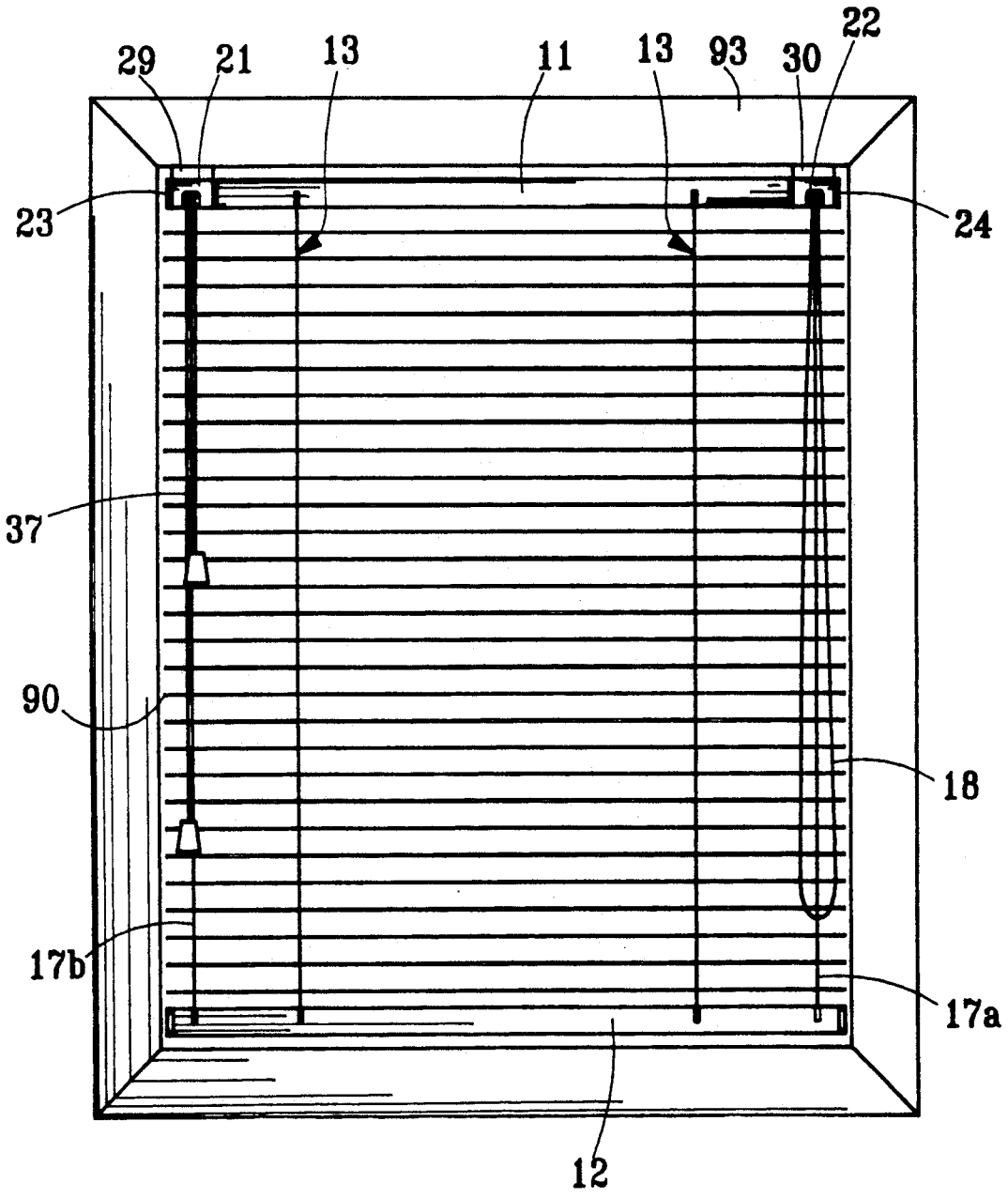
FIG. 2 is a front view of the blind according to the present invention as installed to a window frame.
Figure 3:
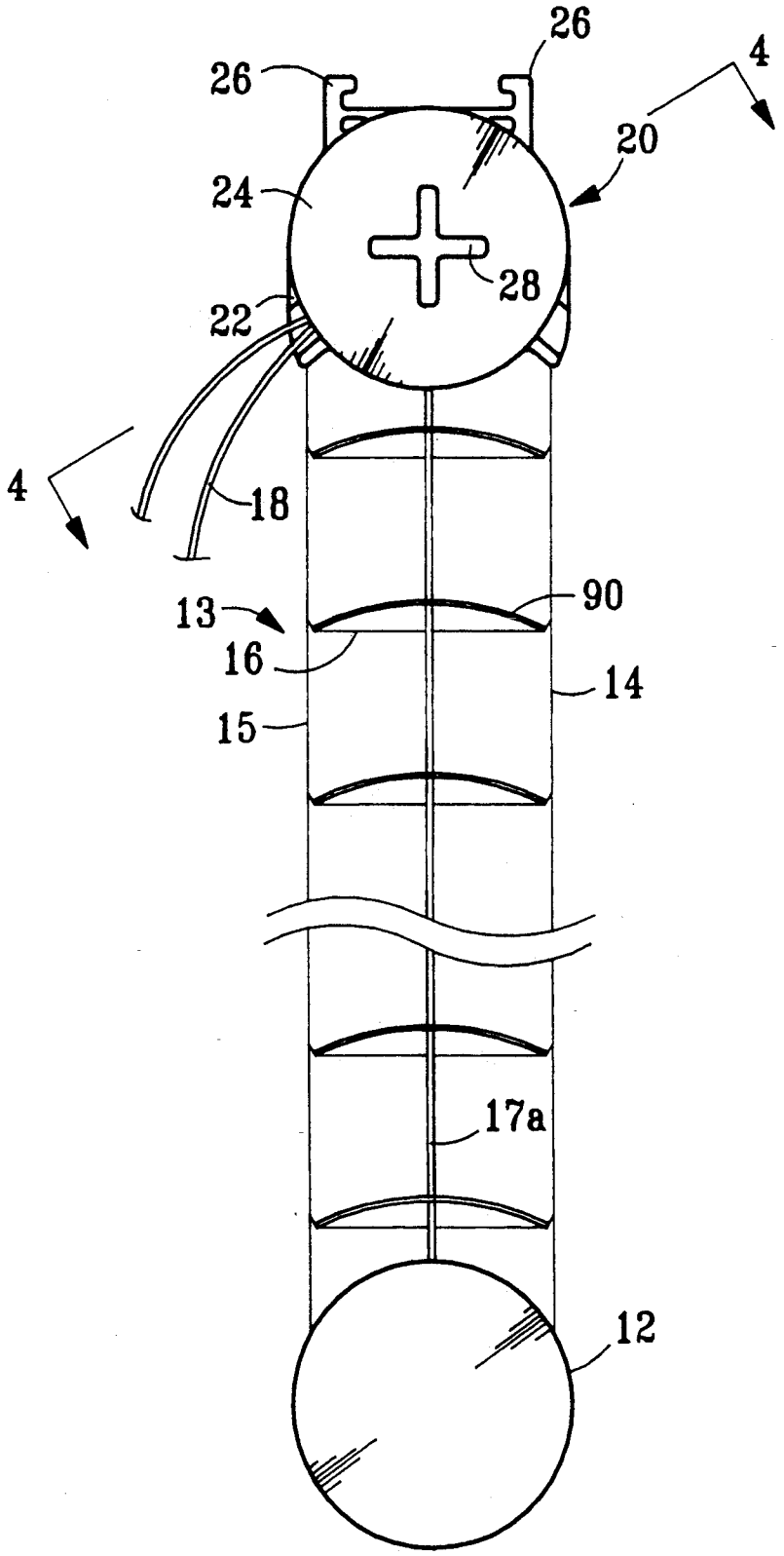
FIG. 3 is a magnified side view of the blind according to the present invention.
Figure 4:
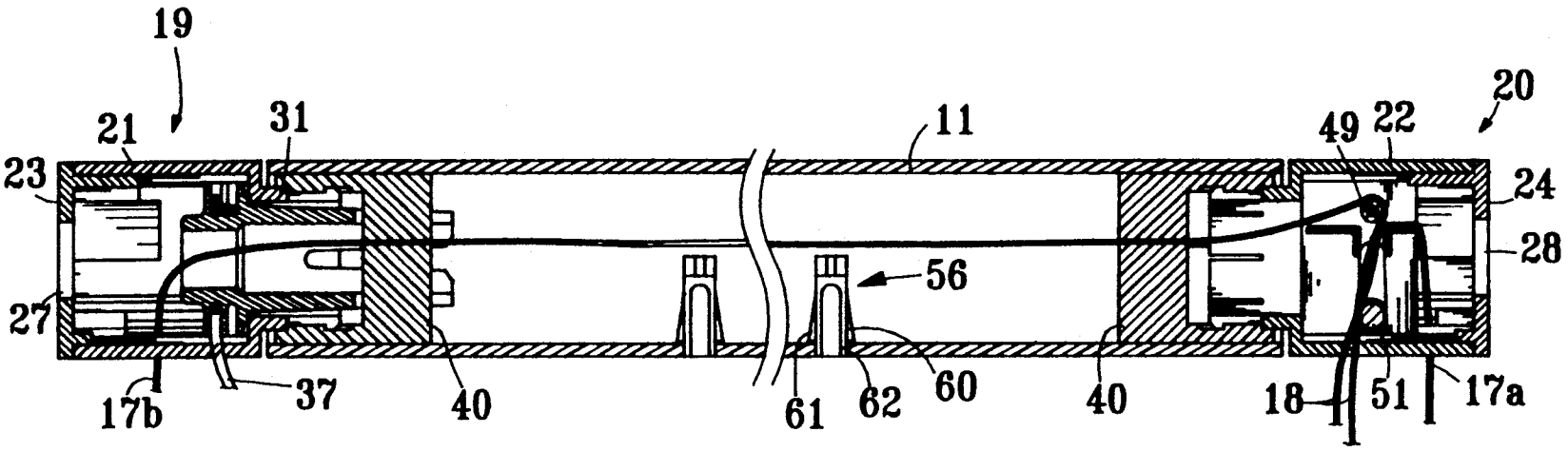
FIG. 4 is a sectional view taken along line 4—4 in FIG. 3.
Figure 5:
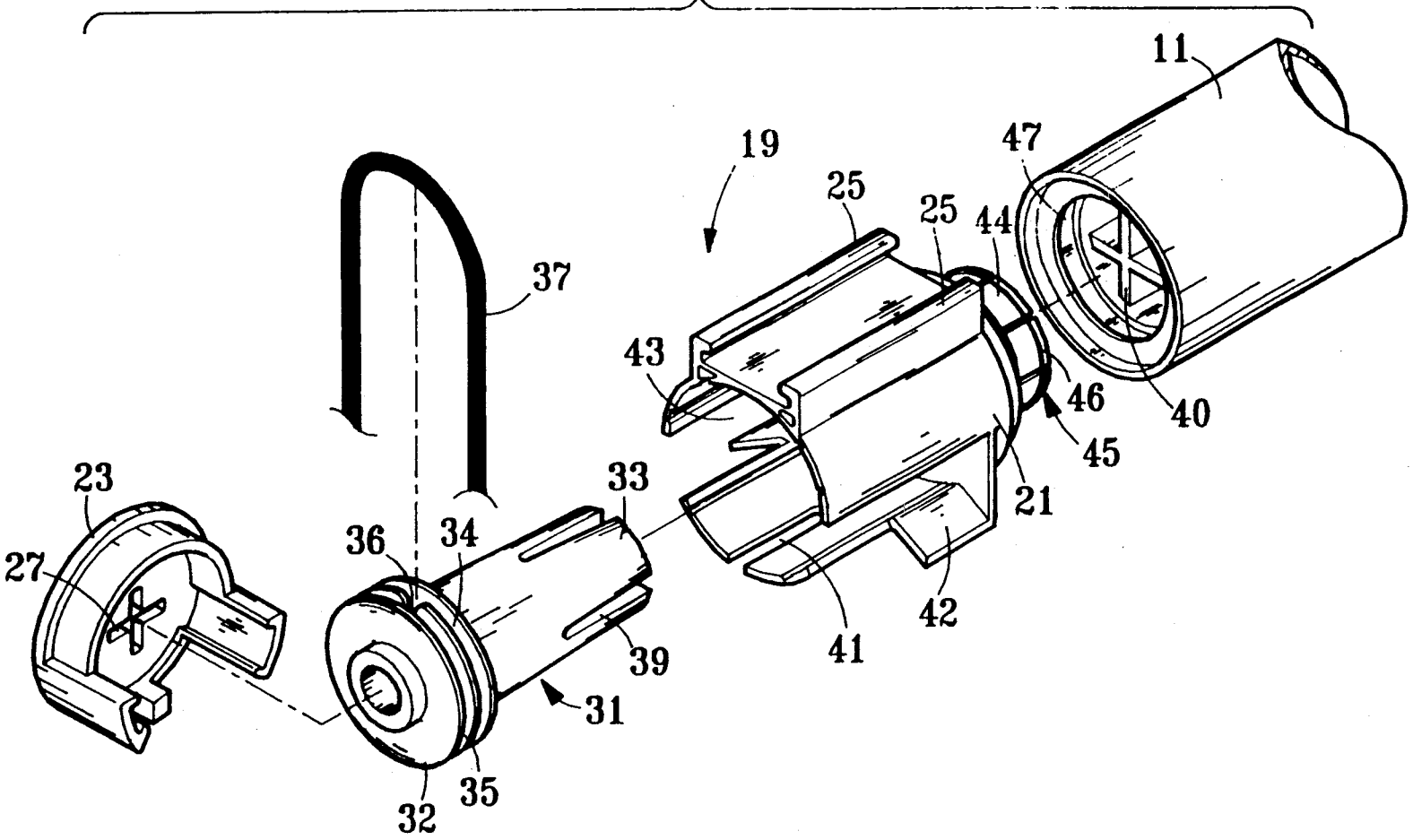
FIG. 5 is a perspective fragmented view of the tilter according to the present invention.

Please refer to FIGS. 2 and 4, the ends of the lift cord (18) is, after passing through the brake wheel (51) and the pulley (49), extended respectively toward to the drums (21 and 22) at two opposite ends of the tubular headrail (11), and then passing through the middle cord outlet of each drum (21 or 22), extended downward till a cord holder located near the respective ends of the tubular foot rail (12). In this embodiment, the ends of the lift cord (18) is indicated as (17*a*) and (17*b*) to ease distinction, and it should be understood that the pull cords (17*a* and 17*b*) refer to the ends of a single cord (18).

Figure 12:
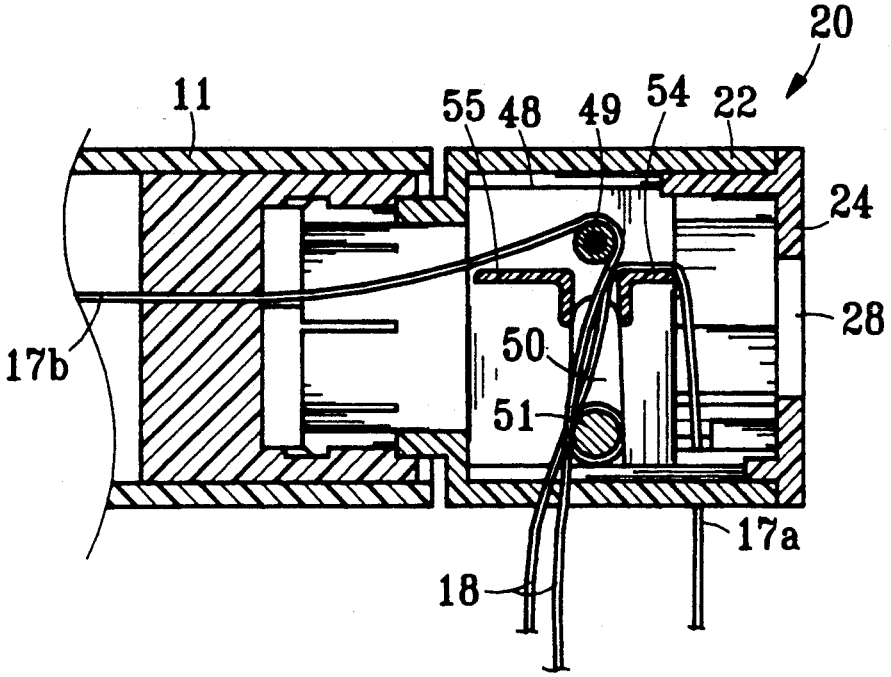
FIG. 12 is a sectional view taken along line 12—12 in FIG. 11.

As shown in FIG. 12, when the lift cord (18) is suspended naturally, the brake wheel (51), with its own weight, is displaced downward to a release position at the bottom of the guide channel (50) to permit downward pulling of the lift cord (18) so that the pull cords (17*a* and 17*b*) are displaced synchronously to raise the tubular foot rail (12) and consequently bring the slats (90) together so that the slats (90) are at nearly closing condition. When downward pulling of the lift cord (18) is stopped, the pull cords (17*a* and 17*b*) and the tubular foot rail (12) are displaced downward by the weight of the slats (90) and the tubular foot rail (12) so that the slats are fully opened at equal distance.

Figure 13:
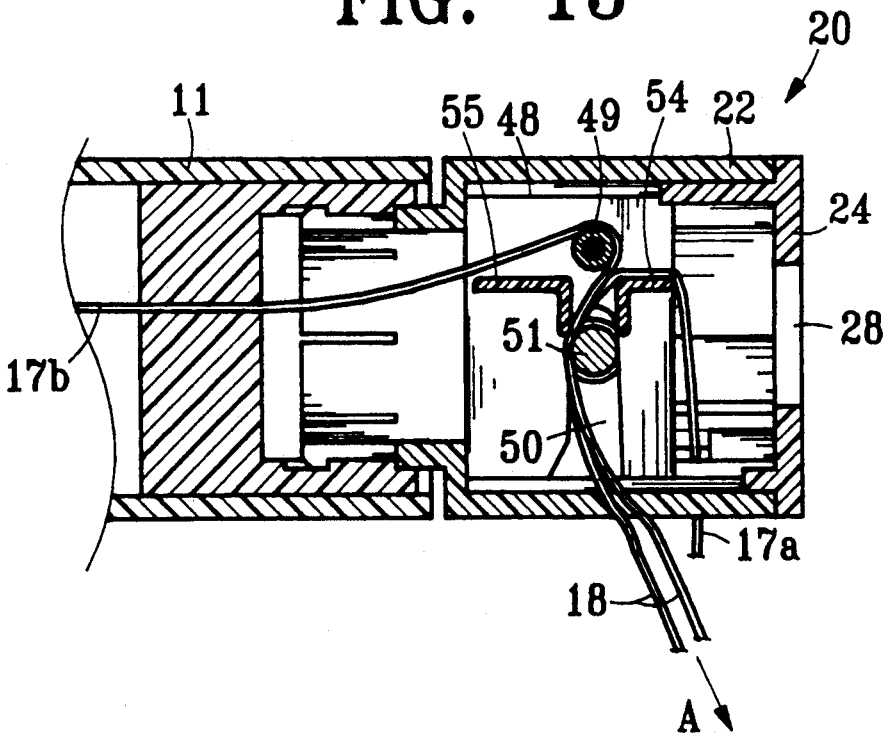
FIG. 13 is similar to FIG. 12, except the brake wheel in FIG. 12 is at the release position, but the brake wheel in FIG. 13 is at the braking position.

As shown in FIG. 13, to maintain the Venetian blind at fully closing or partly opening condition, the lift cord (18) is pulled outward in the direction shown by the arrow A after a downward pulling force is applied to raise the slats (9) in order to force the brake wheel (51) to subject to an upward component force and displace to a braking position on the top of the guide channel (50). Above the braking position there are two symmetric L-like fixing elements (54 and 55) to act in association with the brake wheel (51) to retain the lift cord (18) to withstand the gravity of the slats (90) and the tubular foot rail (12), and then prevent the slats (90) from further displacement to fully opening condition, but maintain them at fully closing or partly opening condition. Because of the teeth-like pattern on the brake wheel (51), and since the lift cord (18) is formed by twisting of a plurality of wires to provide a rough surface, there is a considerable friction between the brake wheel (51) and the lift cord (18) to maintain at the braking position when the brake wheel (51) is engaged tightly with the lift cord (18) after release of the outward pulling force. To release the braking condition, an inward pulling force is applied to separate the brake wheel (51) and the lift cord (18) to displace the brake wheel (51) downward with its own weight to the release position.

Each L-like fixing element (54 or 55) has a round corner at its turning point to prevent from wearing of the control cord (18) as well as the pull cords (17*a* and 17*b*).

Figure 14:
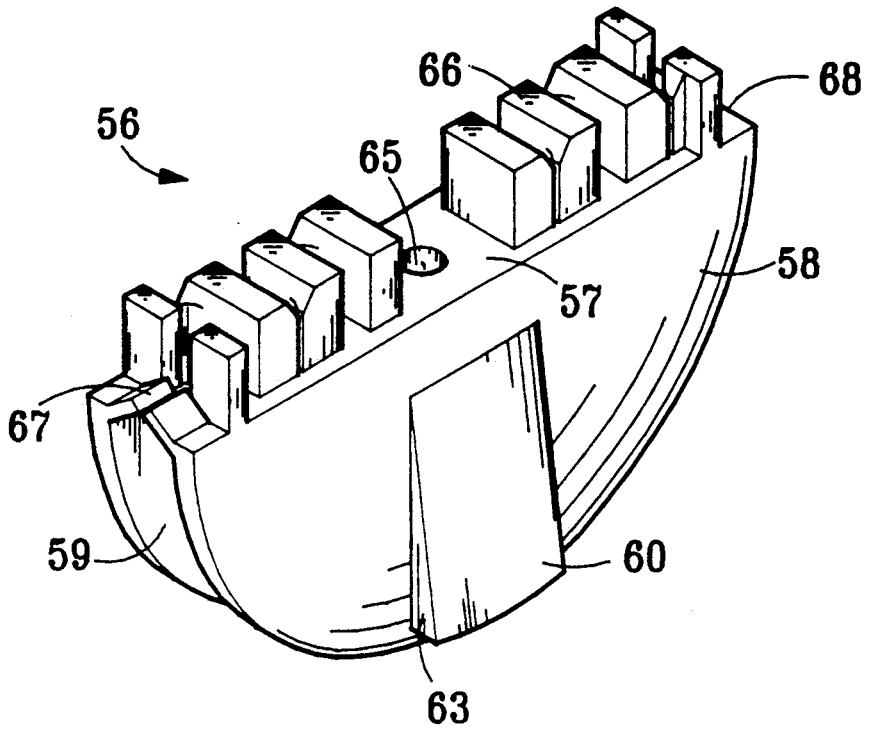
FIG. 14 is a perspective view of the ladder and cord holder for the blind according to the present invention.
Figure 15:
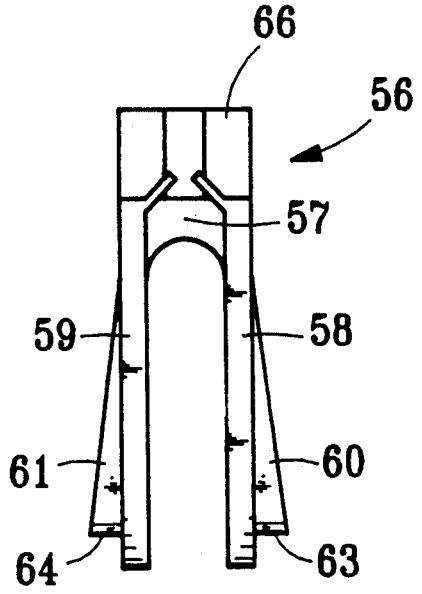
FIG. 15 is a side vie of the ladder and cord holder according to the present invention.

Please refer to FIGS. 14 and 15, each holder (56) to tie the ladder (13) and the pull cords (17*a* and 17*b*) comprises a top plate (57) having a middle passing hole (65), a projected surface (66) on the top of the top plate (57) to retain the ladder (13), two substantially parallel semi-circular extension elements (58 and 59) each extended downward from a side of the top plate (57), and a wedge stop (60 or 61) with a stop bottom (63 or 64) having a gradually increasing thickness and extended outward from each extension element (58 or 59). As shown in FIG. 4, the holder (56) can be inserted into a semi-circular slot (62) formed on the headrail (11) or the foot rail (12) and fixed tightly therein. When the respective wedge stops (60 and 61) have completely passed the headrail (11) and the foot rail (12), they tend to expand outward by their own elasticity so that their stop bottoms (63 and 64) are closely engaged with the inner walls of the headrail (11) and the foot rail (12) respectively. Hence, it is a design of holder which can be assembled easily and is capable to withstand heavy load without risk of disengagement.

Figure 16:
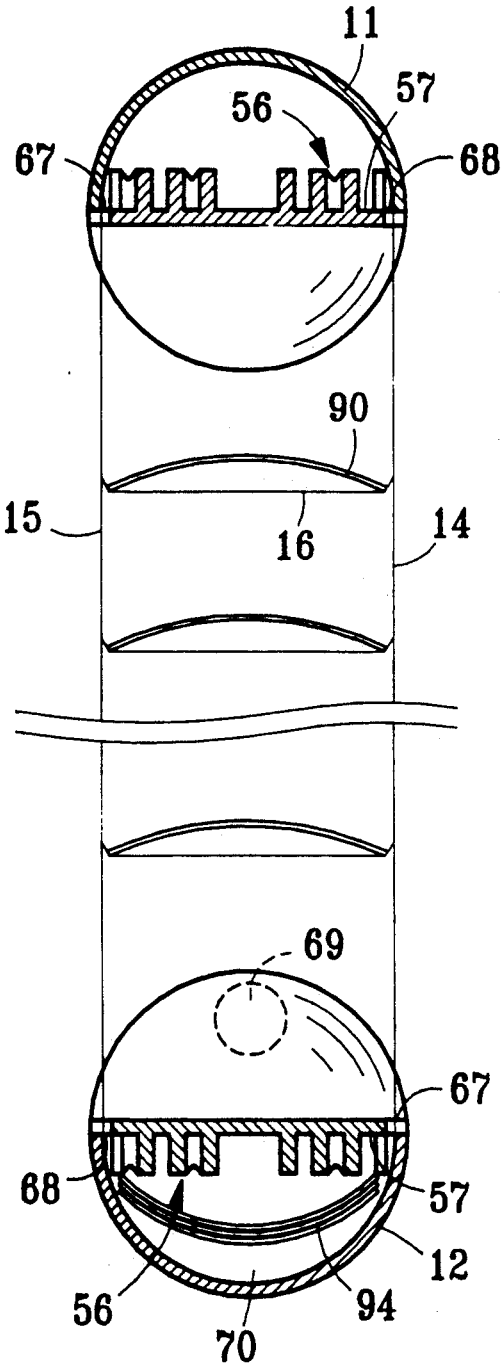
FIG. 16 is a longitudinal sectional view of the slats at horizontal position in the blind according to the present invention.
Figure 17:
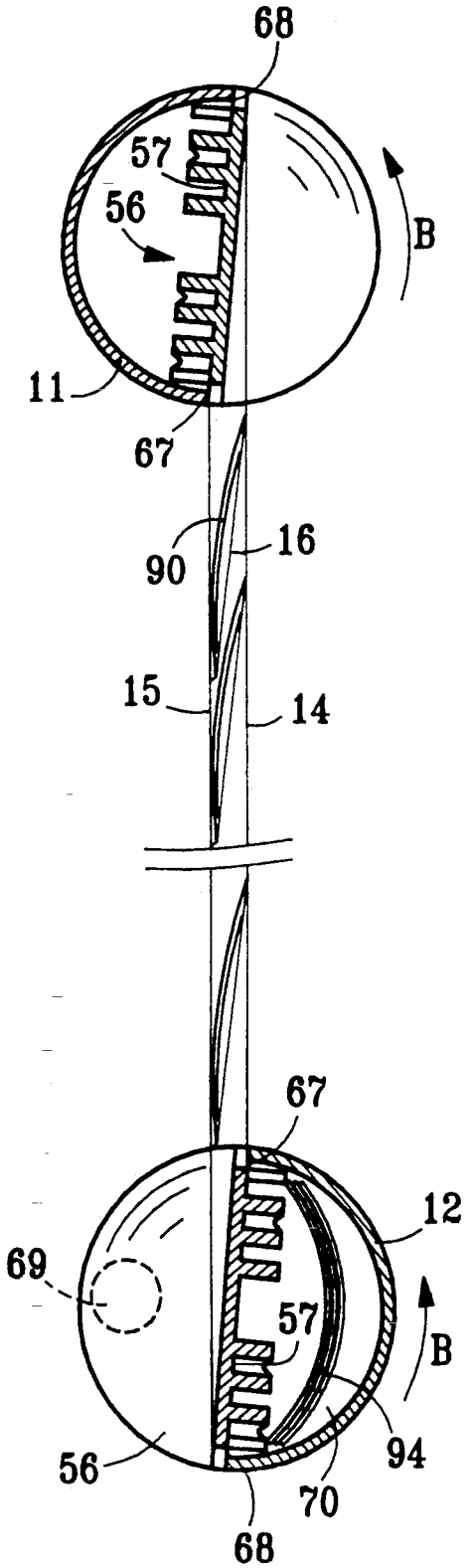
FIG. 17 is longitudinal sectional view of the slats at 85 degree tilting position in the blind according to the present invention.

Please refer to FIGS. 16 and 17, the side ladders (14 and 15) of the ladder set are tied to side holes (67 and 68) of the top plate (57) respectively, and each of the pull cords (17*a* and 17*b*) is tied (not shown) after passing the middle hole (65). Therefore, when the tilt cord (37) is pulled to cause the tubular headrail (11) with the holder (56) to rotate outward for certain angle in the direction indicated by an arrow B, the inner ladder tape (14) is displaced upward linearly, and the outer ladder tape (15) is displaced downward linearly, but the tubular foot rail (12) is driven to rotate for a same degree in the same direction as shown by the arrow B. Since the side ladders (14 and 15) are displaced in two opposite directions linearly, the horizontal connecting tapes (16) supporting the respective slats (90) drive the slats (90) to tilt outward accordingly for a same degree. The holder (60) used in the present invention is materially a plate which is different from the conventional cylindrical ladder holder (ladder cylinder), and it is entirely different from the conventional ladder cylinder in effect to tilting degree. The side ladders (14 and 15) at both sides of the top plate (57) ca be extended into the gap between the two extension elements (58 and 59) so that they are close to each other, and consequently the side ladders (14 and 15) are maintained substantially parallel when the slats (90) are declined, then all slats (90) are tilted to the same degree which is also same with the degree which the holder (56) is turned. On the contrary, the conventional ladder cylinders prevent the side ladders to close to each other when the slats are tilted, consequently the side ladders are twisted, and unavoidably the degree of tilting of the slats at the top and bottom is very different from that at the middle.

Another factor affecting the ability of the slats to tilt is ladder stretch. In the present invention, a plurality of counterweights (69) are placed in the middle on the top side of the tubular foot rail (12). The counterweights (69) rotates for a same degree following the rotation of the tubular foot rail (12). As shown in FIG. 17, when the tubular foot rail (12) turns outward, the counterweights (69) is displaced outward accordingly, the eccentric horizontal distance between the counterweights (69) and the center point of the tubular foot rail (12) is increasing proportional to the rotating degree of the tubular foot rail (12). In other words, the gravity of the counterweights (69) is increasing proportional to the rotating degree, and distributed to the outer ladder tape (15) which is not subject to the gravity of the slats (90), then the inner ladder tape (14) subjected to gravity of the slats (90) and the outer ladder tape (15) subjected to the gravity of the counterweights (60) are maintained balanced in spite of the rotating degree of the tubular foot rail (12), consequently the stretches of the respective side ladders (14 and 15) are maintained balanced and their effect to the ability of the slats (90) to tilt is minimized. Moreover, the greater the rotating degree of the tubular foot rail (12), the closer the slats (90) due to the weight of the counterweights. Hence, the Venetian blind (10) according to the present invention can be closed satisfactorily.

Figure 18:
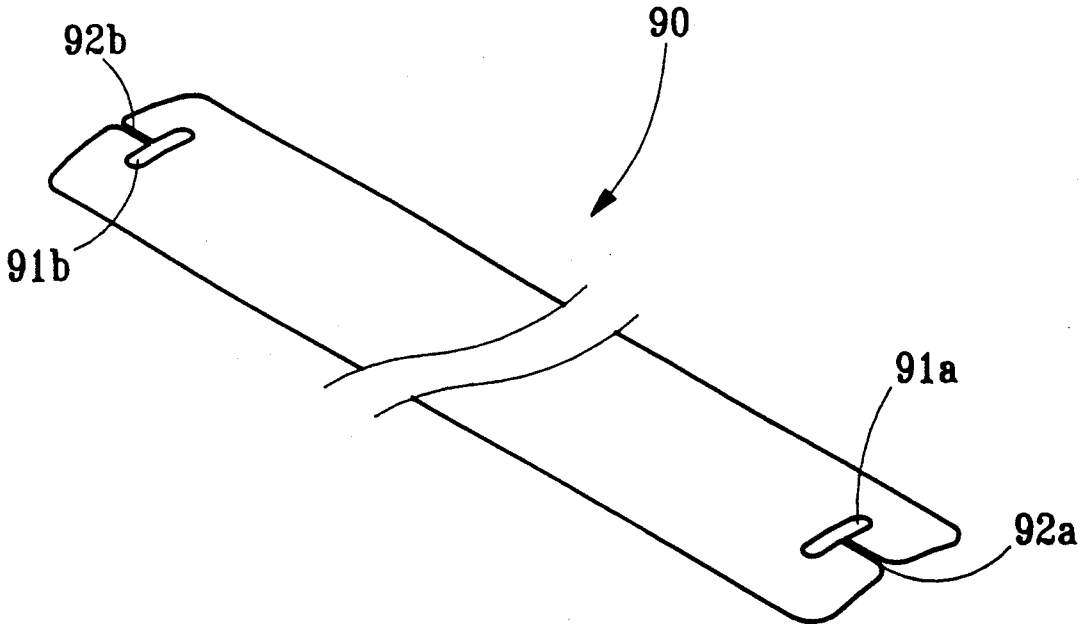
FIG. 18 is an enlarged perspective view of a single slat of the blind according to the present invention.

Please refer to FIG. 16, after installation of the holder (56) and the counterweights (69), the tubular foot rail (12) still has a space (70) at the lower half portion to store a plurality of spare slats (94) for replacement of damaged slats (90). As shown in FIG. 1 and FIG. 18, each slat (90) has a hole (91*a* or 91*b*) at each end for passing through of a cord end (17*a* or 17*b*). Each of the hole (91*a* or 91*b*) has a notch (92*a* or 92*b*) to connect to the external to permit easy assembly or replacement of slat (90). It is indeed a do-it-yourselves (DIY) Venetian blind with a tilting ability superior to the prior art. The holes (91*a* and 92*b*) can be prolonged if required to increase degree of tilting.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A rotary tubular headrail blind comprising a rotary tubular headrail with a plurality of semi-circular recessions with openings facing downward;

a tubular foot rail with a plurality of semi-circular recessions with openings facing upwards;

a plurality of holders each firmly secured in a semi-circular recession of the headrail and the foot rail, each having a top plate with a hole in the middle, a first end and a second end at furthest sides, and two semi-circular extension elements extended downward from the top plates with an appropriate gap between them;

at least two ladder sets each fixed to a holder at the headrail, extending downward and fixed to another holder at the foot rail, comprising an inner ladder tape fixed to the first ends of both holders, an outer ladder tape fixed to the second ends of both holders, and a plurality of horizontal connecting tapes running in parallel and equal distance between the inner and outer ladders;

a soft lift cord to lift and lower the foot rail linearly, with its two ends extended from the headrail downward vertically to the foot rail and secured to the middle holes of the respective holders;

a plurality of slats placed above the respectively horizontal connecting tapes, each slat having a hole at an end for passing through of the lift cord;

a lifter to retain the soft lift cord tentatively; and a tilter to rotate the headrail and to drive the inner and outer ladders to displace linearly in two opposite directions when the headrail is rotate in a way that the inner and other ladders are extended to a gap between the two semi-circular extension elements of the holder to maintain close and parallel to each other so as to tilt the slats for a degree same with the degree of rotation.

2. A rotary tubular headrail blind as claimed in claim 1 wherein the tilter comprising a fixed hollow drum secured to the headrail;

an end cover firmly secured to the hollow drum to define in the hollow drum a middle cord outlet for freely passing of a control cord and two cord outlets symmetrically located on two ends of the hollow drum;

a hollow rotary mechanism rotatably fixed in the hollow drum, including a pulley section and an fixing section extended out of the hollow drum and engaged with the headrail for synchronous motion;

a soft tilt cord wound around the pulley section and having an end extended out of the cord outlet, providing an adequate friction with the pulley section so that the rotary mechanism and the headrail are rotated synchronously by pulling of the tilt cord.

3. A rotary tubular headrail blind as claimed in claim 1 wherein the lifter comprising a fixed hollow drum secured to the headrail;

an end cover firmly secured to the hollow drum to define in the hollow drum a middle cord outlet for freely passing of a lift cord and two cord outlets symmetrically located on two ends of the hollow drum;

a pulley block fixed in the hollow drum, having a guide channel and two symmetric L-like fixing elements located at two opposite sides above the slide ways;

a pulley at the pulley block at a position just above the guide channel; and a brake wheel with teeth-like pattern engraved on its surface, around which the lift cord is wound with both ends of the lift cord extended between the brake wheel and the pulley so as to drive the brake wheel to displace between a braking position and a release position in the guide channel by pulling the lift cord slantwise; to retain the lift cord by action of the brake wheel at the braking position and the two L-like fixing elements; and to permit free pulling of the lift cord while the brake wheel is at the release position.

4. A rotary tubular headrail blind as claimed in claim 3 wherein the pulley block is aligned with a lift cord outlet at either side of the hollow drum of the lifter.

5. A rotary tubular headrail blind as claimed in claim 1 wherein a plurality of counterweights are placed at the middle of the top of the foot rail and the counterweights can rotate following rotation of the foot rail for a same degree.

6. A rotary tubular headrail blind as claimed in claim 1 wherein the hole at each end of each slat has a notch to permit free passing through of the lift cord.

7. A rotary tubular headrail blind as claimed in claim 6 wherein the foot rail has an interior space for storage of a plurality of spare slats.

8. A rotary tubular headrail blind as claimed in claim 1 wherein the holder further includes two wedged stops each extended from a semi-circular extension element from a side of the holder, having a stop bottom and a thickness increasing downward gradually.

* * * * *